United States Patent [19]

Bessho

[11] Patent Number: 4,879,539

[45] Date of Patent: Nov. 7, 1989

[54] LAMINATED COIL FOR AN EDDY-CURRENT TYPE STRONG AC MAGNETIC FIELD GENERATOR

[75] Inventor: Kazuo Bessho, Kanazawa, Japan

[73] Assignee: Kanazawa University, Kanazawa, Japan

[21] Appl. No.: 307,524

[22] Filed: Feb. 8, 1989

[30] Foreign Application Priority Data

Mar. 7, 1988 [JP] Japan ..... 63-51704

[51] Int. Cl.[4] ..... H01F 5/00

[52] U.S. Cl. ..... 335/299; 335/296

[58] Field of Search ..... 335/299, 296, 300, 243, 335/250

[56] References Cited

U.S. PATENT DOCUMENTS 4,736,176 4/1988 Aubert ..... 335/299
4,745,387 5/1988 Aubert ..... 335/299

FOREIGN PATENT DOCUMENTS 1491786 9/1966 France ..... 335/299
142508 8/1983 Japan .
84103 4/1988 Japan .
229704 9/1988 Japan .

*Primary Examiner*—George Harris
*Attorney, Agent, or Firm*—Spencer & Frank

[57] ABSTRACT

The disclosed coil is for a strong AC magnetic field generator with coaxially laminated eddy-current carrying conductor disks each of which disks have a central hole and a radial slit. Each turn of the coil consists of an annular conductor plate disposed between adjacent disks and each turn is insulated from the adjacent conductor disks by insulation rings inserted between the annular conductor plate and the adjacent conductor disks. The annular conductor plate and the insulating rings in each turn of the coil have radial slits. The slits in one coil turn are aligned in a radial direction, but the slits of adjacent coil turns are angularly displaced with respect to the central hole of the conductor disk. A slitted end of the annular conductor plate of each coil turn is connected to that of the immediately neighboring coil turn through the radial slits of the conductor disk and the insulation ring.

2 Claims, 3 Drawing Sheets

LAMINATED COIL FOR AN EDDY-CURRENT TYPE STRONG AC MAGNETIC FIELD GENERATOR

BACKGROUND OF THE INVENTION

1. Field of the Invention

This invention relates to a laminated coil for an eddy-current type strong alternating-current (AC) magnetic field generator which is suitable for various research works in magnetic properties of materials such as magneto-optics, in power magnetics, in bio-magnetics, and in nuclear fusion. More particularly, the invention relates to a laminated coil of the above type which is very simple in construction and is easy to manufacture.

2. Overview of the Invention

A laminated coil of the invention is for excitation of an AC magnetic field generator, and it has a plurality of annular conductor plates disposed one on the other, and each of the annular conductor plates has a radial slit. The slitted edge of each annular conductor is bent toward its adjacent annular conductor plate and connected thereto, so that a coil made of a continuous spiral conductor plate is formed by the annular conductor plates thus connected. One conductor disk with a central hole and a radial slit extending from the central hole is inserted into each of the inter-layer space between adjacent annular conductor plates of the coil, and the conductor disk is insulated from the annular conductor plates by inserting insulation rings between the opposite surfaces of the conductor disk and the facing annular conductor plates. Each insulation ring also has a radial slit. That slitted edge of each annular conductor plate which is bent toward and connected to the adjacent annular conductor plate extends through the radial slits of the conductor disk and the insulation ring.

When an alternating current flows through the laminated coil, an AC eddy current is induced in each conductor disk in its circumferential direction. The eddy current flows along the periphery of the conductor disk except its radial slit, and at the radial slit the eddy current flows along the slitted edge and the peripheral edge of the central hole of the conductor disk. Thus, the density of the eddy current becomes very high along the peripheral edge of the central hole, and a highly concentrated magnetic flux can be induced in the central hole of the conductor disk. In short, with the large AC exciting current, a strong AC magnetic field can be generated in the central hole of the conductor disk. The laminated coil of the above structure is characterized in that its impedance is very low, and a very large exciting current can be fed through it. Accordingly, a very high concentration of eddy currents can be produced along the edge of the central hole of each conductor disk, so that a strong AC magnetic field can be generated efficiently in the central hole. Further, the above-mentioned laminated coil is very easy to manufacture. Related Art Statement Much efforts are currently undertaken for research and development of strong magnetic field generators by using large-scale experimental facilities, in order to promote investigations and studies of properties of materials in strong magnetic field, preparation and testing of new materials and experiments on nuclear fusion.

Conventional strong magnetic field generators can be classified into several groups; namely, destructive pulse strong magnetic field generators such as those of KNER method and the implosion method, nondestructive pulse strong magnetic field generators such as those of the multilayered coil type and the so-called MIT type, continuous strong magnetic field generators such as those of superconductive type and hybrid type.

The strong magnetic field generators of the prior art provide very strong magnetic fields, but they have shortcomings in that the duration of the strong magnetic fields generated is very short, that special facilities such as extremely low temperature apparatus and large power source apparatus are required, that only pulse or direct-current (DC) magnetic field can be generated, and that continuous generation of strong alternating-current (AC) magnetic field is not possible. On the other hand, the study of bio-magnetics has particularly advanced, and the need for investigation of the relation between the living body and AC magnetic field has increased, so that there is a demand for the development of a strong AC magnetic field generator.

To overcome the above shortcomings of the prior art, the inventors have disclosed a variety of strong AC magnetic field generators in their Japanese Patent Applications No. 57-25,517 and No. 61-228,459, and recently they have disclosed multilayered-eddy-current type strong AC magnetic field generators in their Japanese Patent Application No. 62-62,708 and No. 62-188,921. FIG. 4A and FIG. 4B show eddy-current type AC magnetic field generators which were disclosed by the inventors recently. When an AC current is fed into exciting coils of the magnetic field generator, eddy currents are induced in electric conductors which are magnetically coupled to the coils, and the conductors are connected to such a common central hole that the induced eddy currents are concentrated along the periphery of the central hole. Thereby, the AC magnetic flux density along the central hole is efficiently increased while minimizing the leakage flux.

More specifically, a conductor disk 11 of FIG. 4A has a central hole 12 and branch conductors 13a through 13d in the form of concentric cylindrical walls perpendicular to the plane of the disk 11. The conductor disk 11 of FIG. 4B is similar to that of FIG. 4A except that its branch conductors 13a through 13d are in the form of annular conductors parallel to the plane of the disk 11. In both examples of FIGS. 4A and 4B, the conductor disk 11 has a radial slit 14 extending from its central hole 12 to its periphery through all the branch conductors 13*a* through 13*d*. Exciting coils 15*a* through 15*c* are inserted in the three spaces between adjacent walls of the four branch conductors 13a through 13*d* as shown in the figures.

With an AC exciting current in each of the exciting coils 15*a*, 15*b* and 15*c*, an eddy current is induced in each of the branch conductors 13*a*, 13*b*, 13*c* and 13*d* in the circumferential direction thereof. Due to the presence of the radial slit 14, the path of the eddy current in each branch conductor is closed along the opposite edges of the radial slit 14 and the periphery of the central hole 12. Accordingly, the eddy currents of the individual branch conductors are all led to the periphery of the common central hole 12. Thus, a concentrated high magnetic flux is induced in the central hole 12, and it becomes possible to generate continuously a strong AC magnetic field within the central hole 12.

However, the multilayered-eddy-current type strong AC magnetic field generators which were proposed heretofore have the following shortcomings; namely, that they are difficult to manufacture because the conductor disk with branches has a complicated shape and the exciting coils consist of windings, and that the intensity of the magnetic field to be generated thereby is limited at a comparatively low level because the exciting coil of the proposed type inherently has a high inductance and the conductors of the proposed structure are inherently affected by surface effects. Thus, the multilayered eddy-current type strong AC magnetic field generators of the prior art still have serious problems to be solved.

SUMMARY OF THE INVENTION

Therefore, an object of the present invention is the solve the above-mentioned problems of the prior art by providing a laminated coil for eddy-current type strong AC magnetic field generators. A coil for eddy-current type strong AC magnetic generator according to the invention has simple construction and is easy to manufacture, and when it is used as an exciting coil its impedance is low, and it suits to thin low-surface-effect conductors for carrying eddy currents. Thus, the coil of the invention enables considerable increase of the intensity of magnetic field to be produced by such AC magnetic field generators.

A laminated coil according to the invention is for an eddy-current type strong AC magnetic field generator with a plurality of eddy-current carrying conductor disks, each of which disks has a central hole and a radial slit extending from the central hole. The laminated coil comprises a plurality of annular conductor plates having radial slits respectively, and a plurality of insulation rings with radial slits respectively. The radial slit of each insulation ring preferably has a wider opening than that of the annular conductor plate. Each turn of the coil is formed of a coaxial lamination of one of the annular conductor plates and at least one of the insulation rings with the radial slits of the conductor plates and the insulation rings aligned in a radial direction. The adjacent turns of the coil are coaxially laminated one on the other so as to allow insertion of one of the conductor disks therebetween in an insulated manner. The radial slits of the adjacent turns of the coil being displaced in circumferential direction in such a manner that a slitted end of the annular conductor plate of each turn is brought into contact with the annular conductor plate of the immediately neighboring turn through the radial slits of the insulation ring and the conductor disk.

When the eddy-current type strong AC magnetic field generator is provided with and excited by the above-mentioned laminated coil of the invention, eddy currents are induced in the conductor disks and such eddy currents are concentrated along the periphery of the central holes of the individual disks, so that highly intensified magnetic field can be generated in the holes. Besides, the structure of the laminated coil is very simple and it can be produced at a much lower cost than before, yet it enables a considerable increase in the strength of the magnetic field to be generated by the AC magnetic field generator.

BRIEF DESCRIPTION OF THE DRAWINGS

For a better understanding of the invention, reference is made to the accompanying drawings, in which.

Figure 1A:
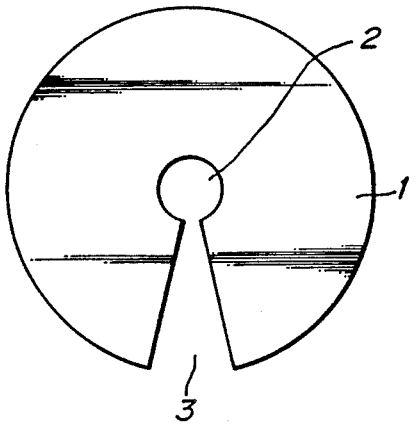
FIGS. 1A, 1B and 1C diagrammatically illustrate examples of essential elements of a laminated coil of the invention, i.e., a conductor disk for carrying eddy current, an annular conductor plate and an insulation ring respectively.

Through different views of the drawings, the followed symbols are used.

1, 1*a*, 1*b*: thin conductor disks,
2: a central hole,
3, 5, 7: radial slits,
4, 4*a*, 4*b*, 4*c*: annular conductor plates,
6: an insulation ring,
8: a cylindrical assembly,
9, 9*a*, 9*b*, 9*c*: alternating currents,
10, 10*a*, 10*b*: eddy currents,
11: a conductor disk,
12: a central hole,
13*a* through 13*d*: branches,
14: a slit,
15*a* through 15*c*: coils.

DESCRIPTION OF THE PREFERRED EMBODIMENTS

The invention will be described now in further detail by referring to embodiments shown in the drawings.

With the present invention, a laminated coil or an exciting coil for inducing eddy currents is formed by using a continuous spiral conductor plate, and a thin conductor disk 1 with a central hole 2 and a radial slit 3 extending from the central hole 2 to its periphery is inserted in each of the inter-turn space of the exciting coil while insulating the conductor disk from the exciting coil. In response to the application of an alternating current to the laminated coil, alternating eddy currents are induced in the thin conductor disks 1 so as to produce a strong AC magnetic field through the central holes 2 of the conductor disks 1.

To facilitate the manufacture of the continuous spiral conductor plate of the laminated coil, individual turns of the coil are at first made in the form of separate annular conductor for plate 4. Such annular conductor plates 4 are coaxially overlaid one over the other so as to form a cylindrical assembly 8. Slitted edge of each annular conductor plate 4 is bent toward the immediately neighboring annular conductor plate 4 and connected thereto. The desired continuous spiral conductors plate can be completed by successively repeating the above bending and connecting of the individual annular conductor plates 4 to that of the adjacent turns in succession.

Figure 1B:
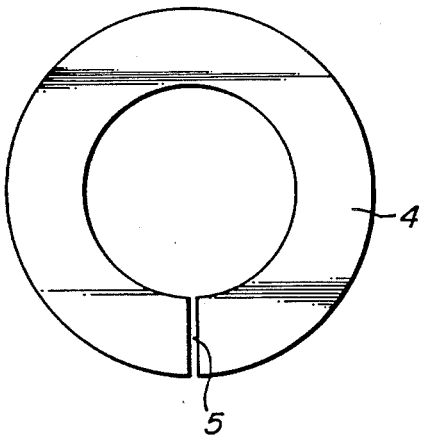
Figure 1C:
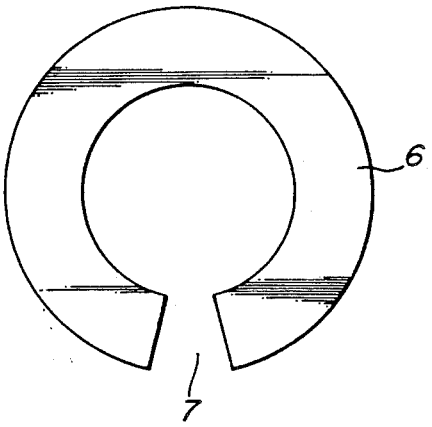

More specifically, each thin conductor disk 1 has a central hole 2 and a radial slit 3, which slit 3 extends from the central hole 2 to the periphery of the disk 1 as shown in FIG. 1A. Preferably, the radial slit 3 of the conductor disk 1 is of sector shape with its opening becoming increasingly larger as it approaches to the periphery. The annular conductor plate 4 for the exciting coil has a radial slit 5 which preferably has narrowly spaced parallel edges as shown in FIG. 1B. The insulation ring 6 for insulating the conductor disk 1 from the conductor plate 4 of the exciting coil is preferably in the form of an annular insulator with a radial slit 7 of sector shape as shown in FIG. 1C. The shape and the size of the insulation ring 6 of FIG. 1C can be similar to those of the annular conductor plate 4 of FIG. 1B except that the radial slit 7 of the insulation ring 6 is wider than the radial slit 5 of the conductor plate 4.

Figure 2:
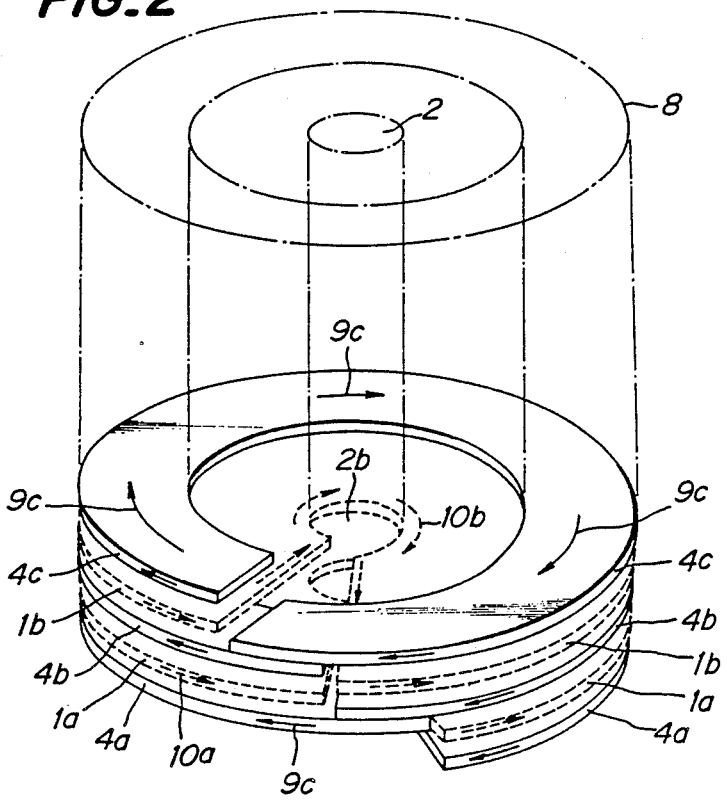
FIG. 2 is an explanatory diagram of the manner in which annular conductor plates of a laminated coil and conductor disks of an eddy-current type AC magnetic field generator are assembled in an embodiment of the invention.

To make the laminated coil for the eddy-current type strong AC magnetic field generator, the annular conductor plates 4 and the thin conductor disks 1 are alternatively overlaid one over the other while aligning the slits 5 and 3 of neighboring conductor plate 4 and the disk 1 as shown in FIG. 2. The insulation rings 6 (not shown in FIG. 2) are inserted between each conductor disk 1 and its adjacent annular conductor plates 4 while aligning the radial slits 7 of the insulation ring 6 with the slits 3 of the conductor disks 1. Thus, a cylindrical assembly 8 is formed as shown by dash-dot lines of FIG. 2. Three annular conductor plates 4*a*, 4*b*, 4*c* and two conductor disks 1*a* and 1*b* are shown in the cylindrical assembly 8.

One slitted edge of, for instance, the annular conductor plate 4*a* is bent toward the immediately neighboring annular conductor plate 4*b* through the radial slits 3*a* and 7 (not shown) of the conductor disk 1a and the insulation ring 6 (not shown), so that the bent edge of the conductor plate 4*a* is connected to the neighboring conductor plate 4*b*. Similarly, one slitted edge of each of the remaining annular conductor plates 4*b*, 4*c*, . . . is bent toward and connected to the immediately neighboring annular conductor plates 4*c*, 4*d* (not shown), . . . , respectively. Thereby, a continuous spiral conductor plate for the exciting coil is formed. For a desired intensity of the AC magnetic field, the necessary number of the eddy-current-carrying thin conductor disks 1 is determined, and the thus determined number of the conductor disks 1 are assembled together with the corresponding number of the annular conductor plates 4 in the form of the cylindrical assembly 8 of FIG. 2.

Figure 3:
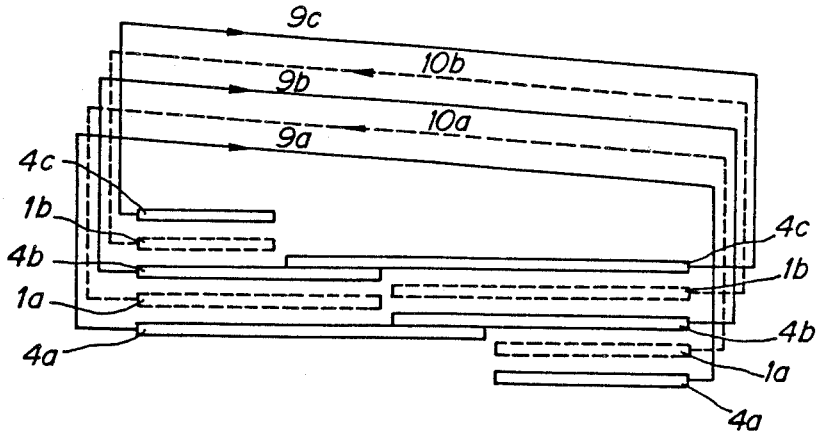
FIG. 3 is a schematic diagram showing the current in the exciting coil and the eddy current induced in the conductor disk of the eddy-current type AC magnetic field generator.

When the exciting coil of the spirally connected conductor plates 4*a*, 4*b*, 4*c*, . . . is connected to an AC power source to feed an AC electric current thereto as shown by currents 9*a*, 9*b*, 9*c*, . . . of FIG. 3, eddy currents 10*a*, 10*b*, . . . are induced in the thin conductor disks 1*a*, 1*b*, . . . in their peripheries adjacent to the conductor plates 4*a*, 4*b*, 4*c*, . . . In each conductor disk 1, such eddy current is induced in the circumferential direction thereof, and due to the presence of the radial slit 3, the path of the eddy current induced along the periphery is closed along the opposing edges of the radial slit 3 and the peripheral edge of the central hole 2, so that the current density at the periphery of the central hole 2 is high. In the example of FIG. 2, if the exciting currents 9*a*, 9*b*, 9*c* flow in the clockwise direction in the annular conductor plates of the laminated coil, the eddy currents 10*a*, 10*b* are induced in the counter-clockwise direction at the outer circumference of the conductor disks, and such eddy currents flow in the clockwise direction along the periphery of the central holes 2 of the conductor disks.

Thus, the density of the eddy current becomes high along the periphery of the central hole 2 of each conductor plate 1, so that a high AC magnetic flux density is induced in the inside of the central hole 2. Besides, the magneto-motive forces in the central holes of all the individual conductor disks 1 are generated in the same direction in a cumulative fashion, so that the resultant magnetic flux in the central hole 2 is further intensified by the cumulative effects of the eddy currents in the plurality of conductor disks 1. Thus, an extremely high intensity of the magnetic field can be achieved at the central hole 2.

Figure 4A:
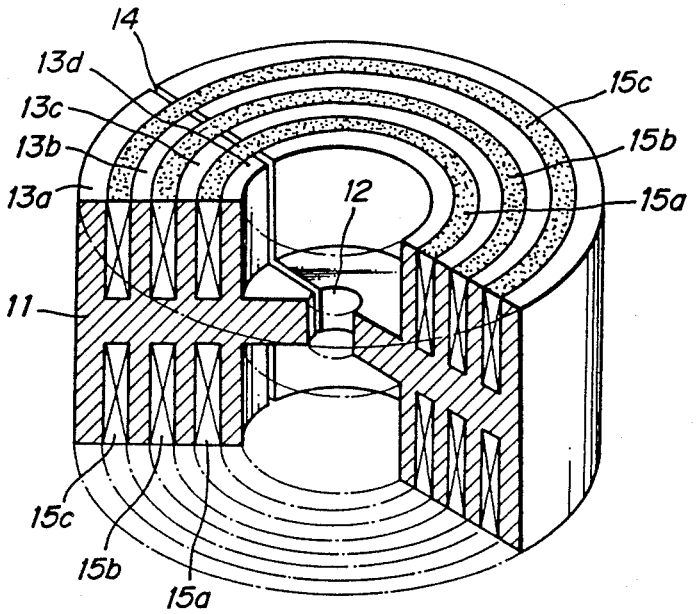
FIGS. 4A and 4B are partially cut away perspective views of conventional multilayered-eddy-current type AC magnetic field generators, respectively.
Figure 4B:
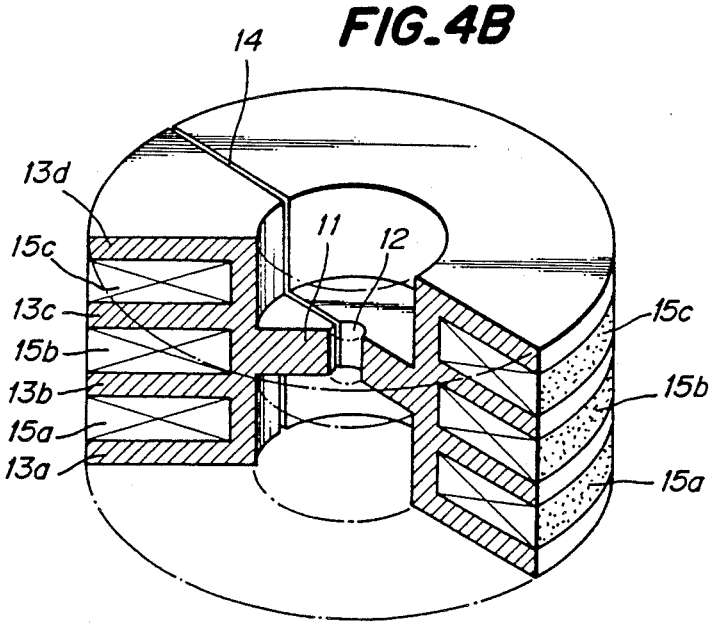

As described in detail in the foregoing, although an eddy-current type strong AC magnetic field generator which is equipped with the laminated coil according to the present invention generates a strong AC magnetic field based on the same operating principle as that of the conventional multilayered-eddy-current type strong AC magnetic field generators of FIGS. 4A and 4B, the present invention considerably simplifies the structure of such magnetic field generator and makes its production much easier. Furthermore, the following effects can be achieved.

(1) A magnetizing coil with that number of turns which is necessary for generating a required intensity of the magnetic field can be formed simply by laminating the number of annular conductor plates.

(2) The use of one continuous spiral conductor plate to form the exciting coil for the induction of eddy currents results in a very low impedance of the exciting coil, so that a large exciting current can be applied to such coil so as to induce a strong eddy current, and a very high magnetic flux density can be generated. Besides, such strong eddy currents in a number of conductor disks can produce cumulative magnetomotive forces, so that an extremely strong AC magnetic field can be generated.

(3) Due to the structural simplicity of the exciting coil and the eddy-current types strong AC magnetic field generator, special alloys with a high mechanical strength such as copper alloys can be used in the exciting coil conductors and the eddy-current-carrying conductors. Further, laminated structure made of such strong alloys can be cooled by a simple cooling system. In short, the structural simplicity provided by the present invention results in a number of advantages of the strong AC magnetic field generators.

(4) The exciting coil of the invention can be energized by an AC power source of variable frequency, so that it facilitates the production of a variable frequency type strong AC magnetic field generator. In addition, a pulse type strong AC magnetic field generator can be formed simply by driving the exciting coil by a pulse power source.

Although the invention has been described with a certain degree of particularly, it is understood that the present disclosure has been made only by way of example and that numerous changes in details of construction and the combination and arrangement of parts may be resorted to without departing from the scope of the invention as hereinafter claimed.

What is claimed is:

1. A laminated coil for an eddy-current type strong AC magnetic field generator with a plurality of eddy-current carrying conductor disks, each disk having a central hole and a radial slit extending from the central hole, said coil comprising a plurality of annular conductor plates having radial slits respectively, and a plurality of insulation rings with radial slits respectively, each turn of the coil being formed of a coaxial lamination of one said annular conductor plate and at least one said insulation ring with the radial slits of the annular conductor plate and the insulation rings being aligned in one radial direction, adjacent turns of the coil being coaxially laminated one of the other so as to allow insertion of one said conductor disks therebetween in an insulated manner, the radial slits of the adjacent turns of the coil being displaced in circumferential direction in such a manner that a slitted end of the annular conductor plate of each turn is brought into contact with the annular conductor plate of an immediately neighboring turn through the radial slits of said each turn and the conductor disk.

2. An eddy-current type strong AC magnetic field generator, comprising a plurality of eddy-current carrying conductor disks, each disk having a central hole and a radial slit extending from the central hole; and a coil formed of a plurality of annular conductor plates having radial slits respectively, and a plurality of insulation rings with radial slits respectively; each turn of the coil being formed of a coaxial lamination of one said annular conductor plate and at least one said insulation ring with the radial slits of the annular conductor plate and the insulation rings being aligned in one radial direction, adjacent turns of the coil being coaxially laminated one on the other so as to have one said conductor disk inserted therebetween in an insulated manner, the radial slit of the conductor disk being aligned with that of an immediately neighboring coil turn, the radial slits of the adjacent turns of the coil being displaced in circumferential direction in such a manner that a slitted end of the annular conductor plate of each turn is brought into contact with the annular conductor plate of an immediately neighboring turn through the radial slits of said each turn and the conductor disk immediately below.

* * * * *